United States Patent [19]

Akly

[11] Patent Number: 5,025,940

[45] Date of Patent: Jun. 25, 1991

[54] BOTTLE HOLDER

[76] Inventor: Cesar Akly, 50-20 61 St., Woodside, N.Y. 11377

[21] Appl. No.: 503,244

[22] Filed: Apr. 2, 1990

[51] Int. Cl.[5] ..... B65D 23/10

[52] U.S. Cl. ..... 215/100 A; 220/94 R; 294/27.1; 294/33

[58] Field of Search ..... 215/100 R, 100 A; 220/94 R; 294/27.1, 32.1, 33

[56] References Cited

U.S. PATENT DOCUMENTS

| | | | |
|---|---|---|---|
| 395,504 | 1/1889 | Nason | 215/100 R X |
| 547,713 | 10/1895 | Courtenay | 294/33 X |
| 1,464,789 | 8/1923 | Ward | 215/100 A X |
| 2,029,051 | 1/1936 | Blevins | 294/33 |
| 2,075,217 | 3/1937 | Milburn | 215/100 A |
| 2,088,387 | 7/1937 | Rice, Jr. et al. | 294/33 X |
| 2,147,758 | 2/1939 | Schneider et al. | 215/100 R X |
| 2,215,411 | 9/1940 | Sebring | 294/33 X |
| 2,905,500 | 9/1959 | Thombs | 220/94 R X |
| 3,979,011 | 9/1976 | Schleicher | 220/94 R |
| 4,842,158 | 6/1989 | Reyes, Jr. | 215/100 A X |

FOREIGN PATENT DOCUMENTS

| | | | |
|---|---|---|---|
| 699989 | 2/1931 | France | 215/100 A |
| 919799 | 2/1963 | United Kingdom | 215/100 A |

*Primary Examiner*—Sue A. Weaver

[57] ABSTRACT

A bottle holder is provided for use with a bottle. The bottle holder consists of a strap member having one end connected to a base member which fits against the bottom of the bottle. The other end of the strap member is connected to a fork gripping member to engage the neck of the bottle, so that a person can grip the strap member and pour out the liquid contents of the bottle.

2 Claims, 1 Drawing Sheet

BOTTLE HOLDER

BACKGROUND OF THE INVENTION

The instant invention relates generally to bottle gripping devices and more specifically it relates to a bottle holder which provides engagement of a soft drink bottle having a large diameter body and narrow neck.

There are available various conventional bottle gripping device which do not provide the novel improvements of the invention herein disclosed.

SUMMARY OF THE INVENTION

A primary object of the present invention is to provide a bottle holder that will overcome the shortcomings of the prior art devices.

Another object is to provide a bottle holder that will engage a soft drink bottle having a large diameter body and narrow neck so as to facilitate serving the contents out of the soft drink bottle.

BRIEF DESCRIPTION

DETAILED DESCRIPTION OF THE PREFERRED EMBODIMENTS

Figure 1:
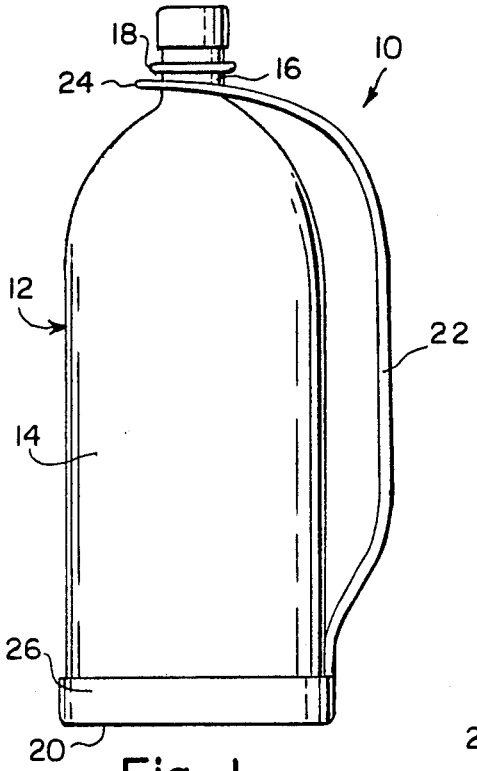
FIG. 1 is an elevation of the invention in use mounted on a bottle.
Figure 2:
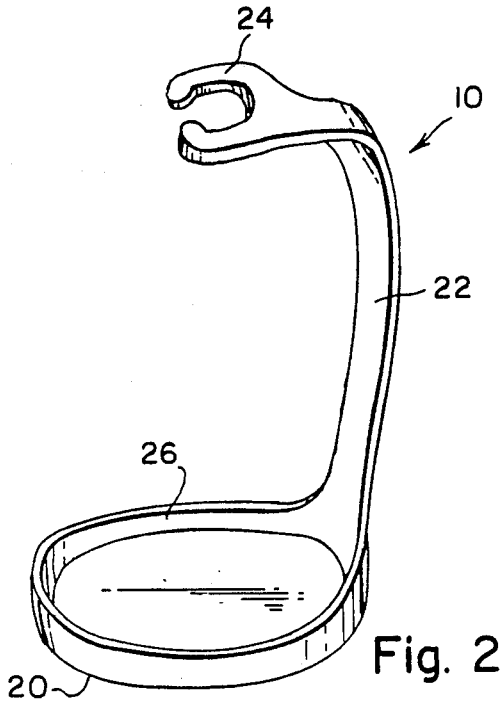
FIG. 2 is a perspective view of the invention.

Turning now descriptively to the drawings, in which similar reference characters denote similar elements throughout the several views, FIGS. 1 and 2 illustrate a bottle holder 10 for use with a bottle 12 having a large body 14 and a narrow neck 16 with an annular flange 18. The bottle holder 10 consists of a substantially horizontal base member 20 which is sized and shaped to fit against the bottom of the large body 14 of the bottle 12. A strap member 22 has one end connected to the base member 20. A substantially horizontal fork gripping member 24 is connected to the other end of the strap member 22 and is adapted to engage the neck 16 of the bottle 12 under the annular flange 18. A person can grip the strap member 22 and pour out the liquid contents of the bottle 12.

The base member 20 is circular and includes an annular flange 26 about its perimeter to prevent the bottom of the bottle 12 from slipping off the base member 20.

Figure 3:
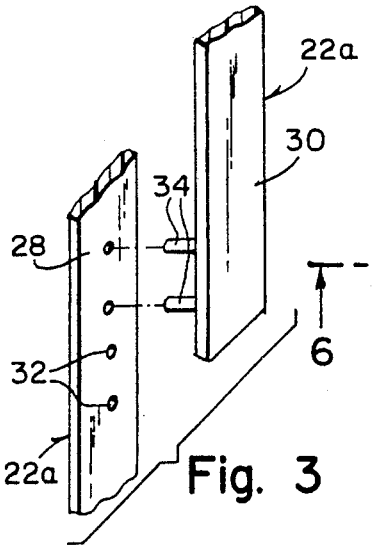
FIG. 3 is a perspective view of a portion of an adjustable strap member.

FIG. 3 shows a modification in which the strap member **22*a* is segmented into two parts 28 and 30. One segmented part 28 has a plurality of vertically spaced apart holes 32 therein, while the other segmented part 30 has two spaced apart transverse pins 34 thereon which engages with any two of the holes 32 to make the strap member 22*a* height adjustable for various sized bottles 12**.

Figure 4:
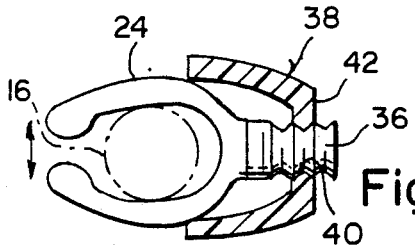
FIG. 4 is a top view partly in section of a retainer threadably connected to a threaded shaft on the fork gripping member to help in holding the fork gripping member to the neck of the bottle.

FIG. 4 shows another modification in which a substantially horizontal short threaded shaft 36 extends from the rear of the fork gripping member 24. A cup shaped retainer 38 affixed to the strap has a threaded hole 40 in the bottom end wall 42 thereof threadably connected onto the short threaded shaft 36. When the retainer 38 is rotated inwardly it will bear against the fork gripping member 24 to help in holding the fork gripping member to the neck 16 of the bottle 12. Alternately the shaft 36 may be rotated to move the gripping member 24 tightly against retainer 38.

Figure 5:
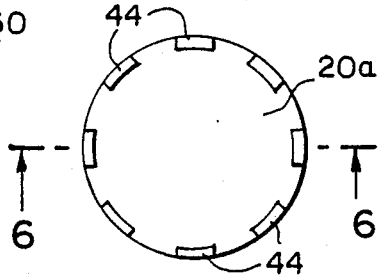
FIG. 5 is a top view of a modified base member having a plurality of engagement fingers thereabout.
Figure 6:
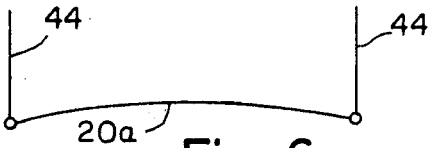
FIG. 6 is a diagrammatic cross sectional view taken along line 6—6 in FIG. 5, showing a flexible curved base member and the fingers before engagement.
Figure 7:
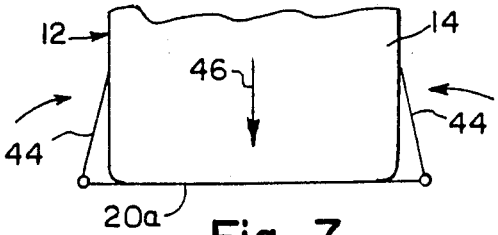
FIG. 7 is a diagrammatic cross sectional view similar to FIG. 6, showing a force being the bottle on the base member which becomes straight and the fingers moving inwardly to the side of the bottle.

FIGS. 5, 6 and 7 show still another modification wherein the base member **20*a* is circular and is normally curved upwardly and includes a plurality of engagement fingers 44 instead of the annular flange 26. The fingers 44 are spaced about the perimeter of the base member 20. When a force 46, being the bottle 12, is placed upon the base member 20*a*, the base member will straighten out, causing the fingers 44 to pivot inwardly against the side of the large body 14 of the bottle 12 to stabilize the bottle on the base member 20*a***. It is noted that base member material must have sufficient flexibility to move downward when forced downward by the bottle and pressure thereon.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bottle holder for use with a bottle having a large body and a narrow neck with an annular flange, said bottle holder comprising:

(a) a substantially horizontal base member which is sized and shaped to fit against the bottom of the large body of the bottle;

(b) a strap member having one end connected to said base member;

(c) a substantially horizontal fork gripping member connected to the other end of said strap member which is sized and shaped to engage the neck of the bottle under the annular flange, so that a person can grip said strap member and pour out the liquid contents of the bottle, wherein said base member has a circular perimeter with a center normally curved upwardly and includes a plurality of engagement fingers extending upwardly spaced about the perimeter of said base member and includes means so that when the bottle is placed upon said base member, said base member center will be forced downward at its center causing the base perimeter and said fingers to pivot upwardly and inwardly against the side of the large body of the bottle to stabilize the bottle on said base member.

2. A bottle holder for use with a bottle having a large body and a narrow neck with an annular flange, said bottle holder comprising:

(a) a substantially horizontal base member which is sized and shaped to fit against the bottom of the large body of the bottle;

(b) a strap member having one end connected to said base member;

(c) a substantially horizontal fork gripping member disposed at the other end of said strap member which is sized and shaped to engage the neck of the bottle under the annular flange, so that a person can grip said strap member and pour out the liquid contents of the bottle, wherein said base member is circular and includes an annular perimeter flange extending upward towards said gripping member about its perimeter to prevent the bottom of the bottle from slipping off said base member, further including:

(d) a substantially horizontal short threaded shaft extending from the rear of said fork gripping member; and (e) a cup shaped retainer of smaller opening than the outer girth of said gripping member, said retainer having an end wall affixed to said strap and having a threaded hole through said end wall threadably connected to said short threaded shaft so that when said shaft is rotated in one direction said gripping member will move against said retainer within said opening whereby said fork gripping member will be tightly held within said retainer to provide a better grip on the bottle.

* * * * *